US008132596B2

(12) United States Patent
Weidler et al.

(10) Patent No.: US 8,132,596 B2
(45) Date of Patent: Mar. 13, 2012

(54) BEAD WEAVING DEVICE

(75) Inventors: Robert F. Weidler, Niceville, FL (US); Renda K. Weidler, Niceville, FL (US)

(73) Assignees: Robert F. Welder, Niceville, FL (US); Renda K. Weidler, Niceville, FL (US)

( * ) Notice: Subject to any disclaimer, the term of this patent is extended or adjusted under 35 U.S.C. 154(b) by 248 days.

(21) Appl. No.: 12/685,270

(22) Filed: Jan. 11, 2010

(65) Prior Publication Data

US 2010/0212770 A1 Aug. 26, 2010

Related U.S. Application Data

(60) Provisional application No. 61/208,380, filed on Feb. 24, 2009.

(51) Int. Cl.
*D03D 29/00* (2006.01)
*A44C 25/00* (2006.01)
*A41H 43/00* (2006.01)

(52) U.S. Cl. ..... 139/29; 139/33; 139/34; 63/37; 63/38; 63/39; 223/48

(58) Field of Classification Search ..... 139/1 R, 139/11, 29–33, 33.5, 34; 63/37–39; 223/48
See application file for complete search history.

(56) References Cited

U.S. PATENT DOCUMENTS

| | | | | | |
|---|---|---|---|---|---|
| 244,452 | A | * | 7/1881 | Halstenbach | 223/48 |
| 752,626 | A | * | 2/1904 | Law | 223/48 |
| 760,919 | A | * | 5/1904 | Poole | 139/29 |
| 1,160,132 | A | * | 11/1915 | Bliss | 139/33 |
| 1,313,765 | A | * | 8/1919 | Traum | 28/151 |
| 1,335,805 | A | * | 4/1920 | Trueb | 223/48 |
| 1,416,752 | A | * | 5/1922 | Putnam | 139/33 |
| 1,417,713 | A | * | 5/1922 | Bolls | 223/48 |
| 1,506,010 | A | * | 8/1924 | Lapin | 206/495 |
| 1,661,877 | A | * | 3/1928 | Lapin | 235/123 |
| 1,726,933 | A | * | 9/1929 | St. John, Jr. | 223/48 |
| 1,807,396 | A | * | 5/1931 | Ellsworth | 33/1 R |
| 2,043,082 | A | * | 6/1936 | Wallach | 28/151 |
| 2,094,505 | A | * | 9/1937 | Thackeray | 139/33 |
| 2,322,730 | A | * | 6/1943 | Kaneb | 223/48 |
| 2,327,957 | A | * | 8/1943 | Brandt | 223/48 |
| 2,427,093 | A | * | 9/1947 | Eckert | 28/152 |
| 2,481,955 | A | * | 9/1949 | Simons | 139/33 |
| 2,529,059 | A | * | 11/1950 | Tell | 223/48 |
| 2,557,854 | A | * | 6/1951 | Adam | 223/48 |
| 2,563,210 | A | * | 8/1951 | Cardi | 223/48 |
| 2,563,510 | A | * | 8/1951 | Cardi | 139/1 R |
| 2,582,008 | A | * | 1/1952 | Clack | 139/33 |
| 2,601,222 | A | * | 6/1952 | Wehrli | 28/151 |
| 2,641,389 | A | * | 6/1953 | Bagdon | 223/48 |
| 2,670,109 | A | * | 2/1954 | Perry et al. | 223/48 |
| 2,797,710 | A | * | 7/1957 | Bintz et al. | 139/33 |
| 2,802,255 | A | * | 8/1957 | Wallach | 28/151 |
| 4,044,446 | A | * | 8/1977 | Segerman | 29/241 |
| 4,160,467 | A | * | 7/1979 | Woodruff | 139/33 |

(Continued)

*Primary Examiner* — Bobby Muromoto, Jr.

(57) ABSTRACT

An apparatus and method of using a bead weaving device for assisting manufacturing by jewelry makers and facilitating the positioning, stringing, cross-weaving, peyote chain maille, and accurate sizing for but not limited to necklaces, bracelets, and other hand woven beaded products. The bead weaving device includes the following components: an inclined sizing plate optionally including an imperial-measure graduated scale and/or a metric-measure graduated scale, a brass toggle half securer, a stabilizer, a support base and removably couplable peyote block attachment and a support arm. The support base of the device is adapted for use on the lap of a user or on the surface of a substrate such as a table.

19 Claims, 6 Drawing Sheets

U.S. PATENT DOCUMENTS

| | | | | |
|---|---|---|---|---|
| 4,316,310 | A * | 2/1982 | Packham | 28/149 |
| 4,462,432 | A * | 7/1984 | Sajo et al. | 139/33 |
| 5,005,273 | A * | 4/1991 | Packham | 28/149 |
| 5,494,734 | A * | 2/1996 | Widders | 442/2 |
| 6,719,013 | B1 * | 4/2004 | D'Estais | 139/29 |
| 7,147,008 | B2 * | 12/2006 | Sayler | 139/29 |
| 7,677,273 | B2 * | 3/2010 | Skaflestad | 139/29 |
| 7,748,413 | B2 * | 7/2010 | Kojima | 139/21 |
| 7,762,284 | B2 * | 7/2010 | Ricks | 139/29 |
| 2005/0205150 | A1 * | 9/2005 | Jenner et al. | 139/11 |
| 2005/0247745 | A1 * | 11/2005 | Spor et al. | 223/48 |
| 2006/0213936 | A1 * | 9/2006 | Ciko et al. | 223/48 |
| 2009/0126822 | A1 * | 5/2009 | Kojima | 139/29 |
| 2010/0065590 | A1 * | 3/2010 | Ricks | 223/48 |

* cited by examiner

BEAD WEAVING DEVICE

CROSS-REFERENCE TO RELATED APPLICATION

The present application is related to and claims priority from prior provisional application Ser. No. 61/208,380, filed Feb. 24, 2009 which application is incorporated herein by reference.

BACKGROUND OF THE INVENTION

1. Field of the Invention

The present invention relates generally to the field of beading and more specifically relates to portable bead weaving devices.

2. Description of the Related Art

Beadwork is the art or craft of stringing seed beads together and/or attaching beads to one another or to cloth, usually by the use of a needle and thread or soft, flexible line such as fishing line. Beadwork may take the form of jewelry or other personal adornment(s), and may be used in wall hangings and sculpture. Beadwork techniques are numerous and may be broadly divided into loom and off-loom weaving, stringing, bead embroidery, bead crochet, and bead knitting.

Modern beadwork is often used as a creative hobby to design jewelry, purses, coasters, and other crafts. Beads are available in a variety of different designs, sizes, colors, and materials, allowing variation among bead artisans and projects. Simple beadwork projects can be created by hand in a short duration, while complex beadwork may take weeks of meticulous work with specialized tools and equipment to complete. Such specialized tools and equipment have been used traditionally to perform 3-D bead weaving projects. 3-D beading may be divided into right angle weaves and peyote stitches. The majority of 3-D beading patterns are done in right angle weave, but sometimes both techniques may be combined in the same piece. Both stitches may be done using either fishing line or nylon thread. Fishing line lends itself better to right angle weaves because it is stiffer than nylon thread, therefore it holds the beads in a tighter arrangement and does not easily break when tugged upon. Nylon thread is more suited to peyote stitch because it is softer and more pliable than fishing line, which permits the beads of the stitch to sit straight without undue tension bending the arrangement out of place.

Right angle weaves may be done using both ends of the fishing line, in which beads are strung in repeated circular arrangements, and the fishing line is pulled taut after each bead circle is made. Peyote stitch is stitched using only one end of the nylon thread. The other end of the string is left dangling at the beginning of the piece, while the first end of the thread progresses through the stitch. In peyote stitch, beads are woven into the piece in a very similar fashion to knitting or cross stitching. Peyote stitch patterns are very easy to depict diagrammatically because they are typically stitched flat and then later incorporated into the piece or left as a flat tapestry. Right angle weave lends itself better as a technique to 3-D beading, but peyote stitch offers the advantage of more tightly knit beads, which is sometimes necessary to properly portray an object in three dimensions.

Traditionally beadwork may also be performed on a loom. When weaving on a loom, the beads are locked in between the warp threads by the weft threads. Although a heddle can be used as in ordinary weaving, the most common technique requires two passes of the weft thread. First, an entire row of beads is strung on the weft thread. Then the beads are pressed in between the warp threads. The needle is passed back through the beads above the warp threads to lock the beads into place. The most difficult part of loomwork is finishing off the warp threads. Bead looms vary in size and are typically made of wood or metal. Some looms have roller bars that allow the weaver to produce pieces that are longer than the loom. Most looms are meant to sit on a table, but some have floor stands or are meant to sit in the lap; however looms are typically not given to ease of portability due to their relative size and weight.

Off-loom bead weaving may be used to weave seed beads together into a flat fabric. Off-loom techniques can be accomplished using a single needle and thread while some use two-needle variations. Different stitches produce pieces with distinct textures, shapes, and patterns. There are a number of different traditional off-loom bead stitches, including: peyote stitch, also known as gourd stitch; brick stitch, also known as Comanche or Cheyenne stitch; square stitch; herringbone stitch, also known as Ndebele stitch; Pondo stitch, also known as African circle stitch; right-angle weave; triangle weave; bead netting; African helix; and Dutch spiral.

Various solutions have been made for providing an efficient beading means such as those found in U.S. Pat. Nos. 760,919; 1,313,765; and 4,160,467.

U.S. Pat. No. 760,919 to Poole discloses a framework that will permit the weaver pressing upon the beadwork from beneath the same and thereby greatly facilitating the manufacturing of the finished article. The framework construction means is assembled for controlling the tension of the warp-threads employed in the construction of the beadwork arid and facilitating the feeding of the completed beadwork to a receiving member carried by the frame when the device is in use. The Poole patent although foldable for ease of transport between locations and for storage purposes appears to be limited to use upon a substrate.

U.S. Pat. No. 1,313,765 to Traum discloses a loom frame which is fitted with means for holding considerable lengths of warp threads so that very long strips of bead work can be woven without removing the work from the loom. A feature of the invention resides in means for winding up or disposing of the woven bead work as the work is completed. With respect to the Traum patent the loom does not appear to be functional for use on the lap of a user, nor does it provide measuring incrementation or means for displaying instructions for use.

U.S. Pat. No. 4,160,467 to Woodruff discloses a hand loom for making woven fabric. The loom includes a frame for supporting warp threading. Warp alignment structure on the frame maintains relative alignment of each thread of the warp. A detachable heddle spindle assembly mounted to the frame includes a rotatably mounted heddle spindle transversely adjacent the warp threading. A first set of slideably positionable heddle fingers is removably installed in a locking slot formed axially on the spindle and the fingers thereof are adapted, aligned and spaced to lift predetermined ones of the warp threading as the spindle is rotated. A second set of heddle fingers is removably installed in a second locking slot axially on the spindle and radially displaced from the first set, the fingers of the second set being adapted, aligned and spaced to lift others of the warp threads. The spindle is rotated so that the first set of heddle fingers lifts some of the warp threads, a weft drawing shuttle may then be passed between the lifted threads and the remaining warp, and so on until the woven fabric is completed. The heddle fingers may have a variety of arrangements and may be programmable so that an unlimited variety of woven patterns may be woven. The warp threading may be installed as a single thread at one side of the frame and then coiled longitudinally thereabout to a desired width, or separate threads may be mounted around the frame to provide warp. A tension adjusting mechanism is provided to bias the warp to a desired tension. Although the Woodruff invention can weave a variety of patterns, it too does not appear to be readily transportable, nor does the loom provide a weaving position comfortable to the user-beader.

Ideally, a bead weaving device should be lightweight, easy to operate reliably and manufactured at a modest expense. Further, a bead weaving device should be able to perform a variety of different weaving techniques in an efficient manner. Thus, a need exists for a portable, reliable bead weaving system to avoid the above-mentioned problems.

BRIEF SUMMARY OF THE INVENTION

In view of the foregoing disadvantages inherent in the known bead weaving art, the present invention provides a novel Beadin' Butler system(s). The general purpose of the present invention, which will be described subsequently in greater detail is to provide a third hand bead-weaving device which assists jewelry makers and facilitates the positioning, stringing, cross-weaving, peyote chain maille, and accurate sizing for but not limited to necklaces, bracelets, and other hand woven beaded products.

The present bead weaving device disclosed herein comprises the following components: an inclined sizing plate optionally including an imperial-measure graduated scale and/or a metric-measure graduated scale, a brass toggle half securer, and a removably couplable peyote block attachment. Further, the present invention may also comprise a stabilizer having an upper plane, a lower plane, a first and second side plane, a distal end plane, and a proximate end plane; wherein the first and second side plane further comprise at least one location suitable for mounting at least one advertising indicia. The support base of the Beadin' Butler may be adapted for use on the lap of a user or on the surface of a substrate such as a table. Additionally, the Beadin' Butler may comprise a removably support arm removably coupled to the distal end plane via fastening means, such as a wing nut threadingly attached to a bolt located integral with distal end of the stabilizer. The stabilizer further comprises at least one securing means for removably attaching at least one set of user-selectable weaving instructions which may comprise a clip or other suitable holding means. The stabilizer may be coupled perpendicular on the top surface of the support base wherein the stabilizer receives the inclined sizing plate at an angle of more or less than or equal to 45 degrees, suitable for a user to create at least one beaded assembly.

The bead weaving device may be sold as at least one kit comprising a set of user instructions and a plurality of bead-weaving instructions for creating at least one jewelry item comprising necklaces, bracelets, anklets and other jewelry in at least one form of cross-weaving, peyote, and/or chain maille. The kit may also comprise at least one peyote block attachment for use in performing peyote stitching.

A method of using the bead weaving device is disclosed herein comprising the steps of: selecting at least one toggle half securer; attaching at least two substantially equal lengths of thread; attaching the user-instructions via securing means to a support arm; continuing weaving until a desired length of jewelry assembly is completed according to at least one graduated scale located on the inclined sizing plate; attaching a complementary toggle bar to the first and second thread ends and securing the first and second thread ends together; and optionally removing residual of the first and second thread ends from the jewelry assembly. The bead weaving device is adapted for use on the lap of a user or on a substrate using the described methods herein.

The present invention holds significant improvements and serves as a Beadin' Butler system. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Beadin' Butler systems.

The various embodiments of the present invention will hereinafter be described in conjunction with the appended drawings, wherein like designations denote like elements.

DETAILED DESCRIPTION

Beadin' Butler systems 100 of the present invention comprises a third hand bead weaving device 102 that may be positioned on a substrate or a lap of at least one user to assist in jewelry manufacturing. The present invention serves to facilitate the positioning, stringing, cross-weaving, peyote, chain maille, and accurate sizing of necklaces, bracelets, and other hand woven beaded products.

Figure 1:
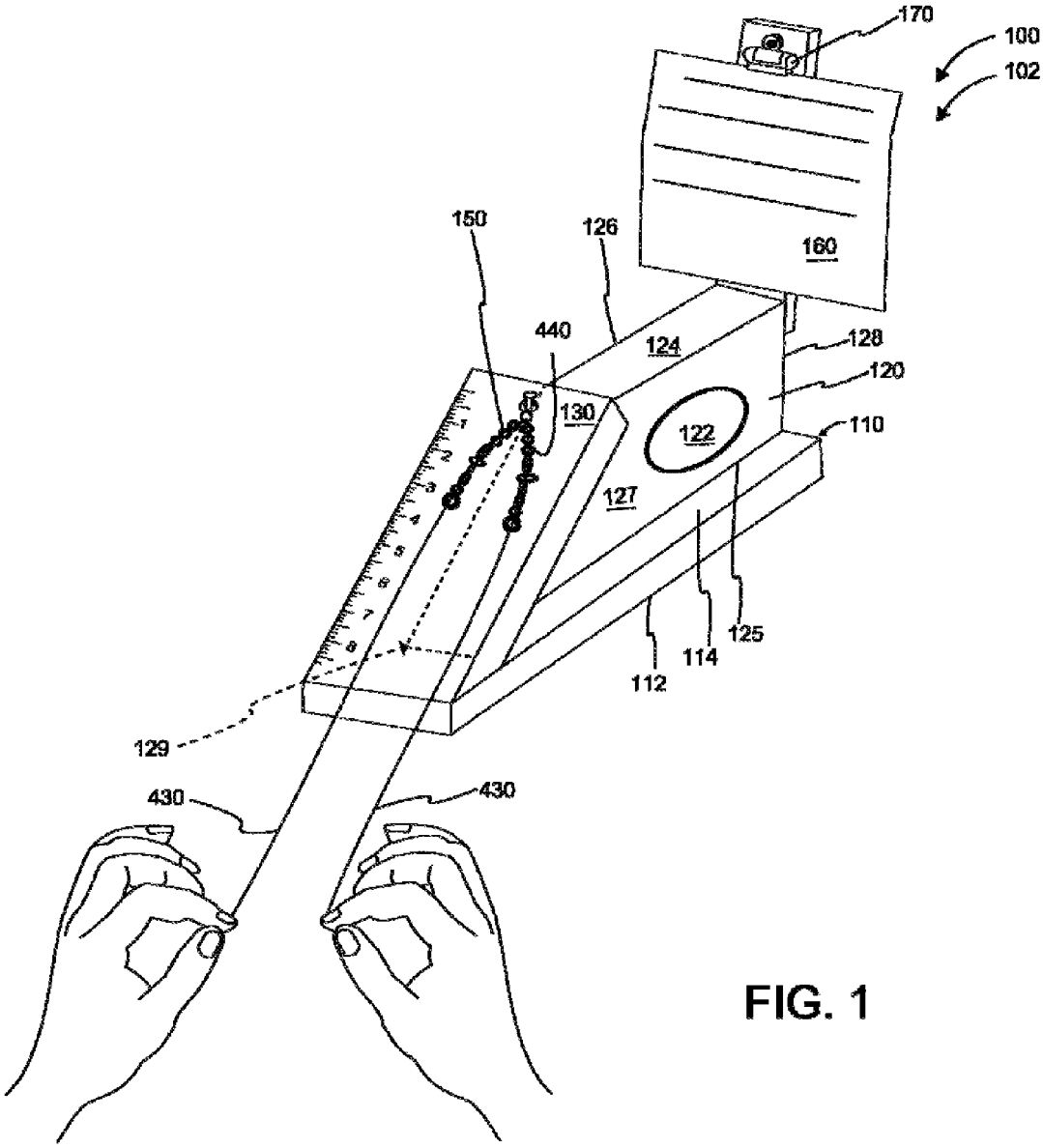
FIG. 1 shows a perspective view illustrating Beadin' Butler systems in an in-use condition according to an embodiment of the present invention.

Referring now to FIG. 1, showing a perspective view illustrating Beadin' Butler system 100 according to an embodiment of the present invention. Beadin' Butler system 100 as disclosed herein may comprise weaving device 102 having at least one substantially rigid support base 110, at least one stabilizer 120, at least one inclined sizing plate 130; and at least one support arm 140.

Support base 110 within this particular embodiment may comprise rigid material such as wood, plastic, ferrous or non-ferrous material, or other such suitable materials that are lightweight, cost-effective and durable. Within the particular embodiment shown the preferred dimensions of support base 110 may comprise a length of about 11", a width of about 2½", and a height of about ½". It should be noted that the above-mentioned dimensions are approximate and are provided as an exemplary means in which to enable the present invention; however other dimensions may be applied and will still be considered to be within the scope and spirit of the invention as disclosed. Support base 110 provides upper and lower surfaces, 112 and 114 respectively. Upper surface 112 provides a substantially flat mounting surface for stabilizer 120 and lower surface 114 provides a substantially flat surface for maintaining a level position while in use on a substrate such as a table or when on a user's lap. In this way the present invention is easily portable and may be used on a variety of different surfaces to provide bead weaving means.

Figure 2:
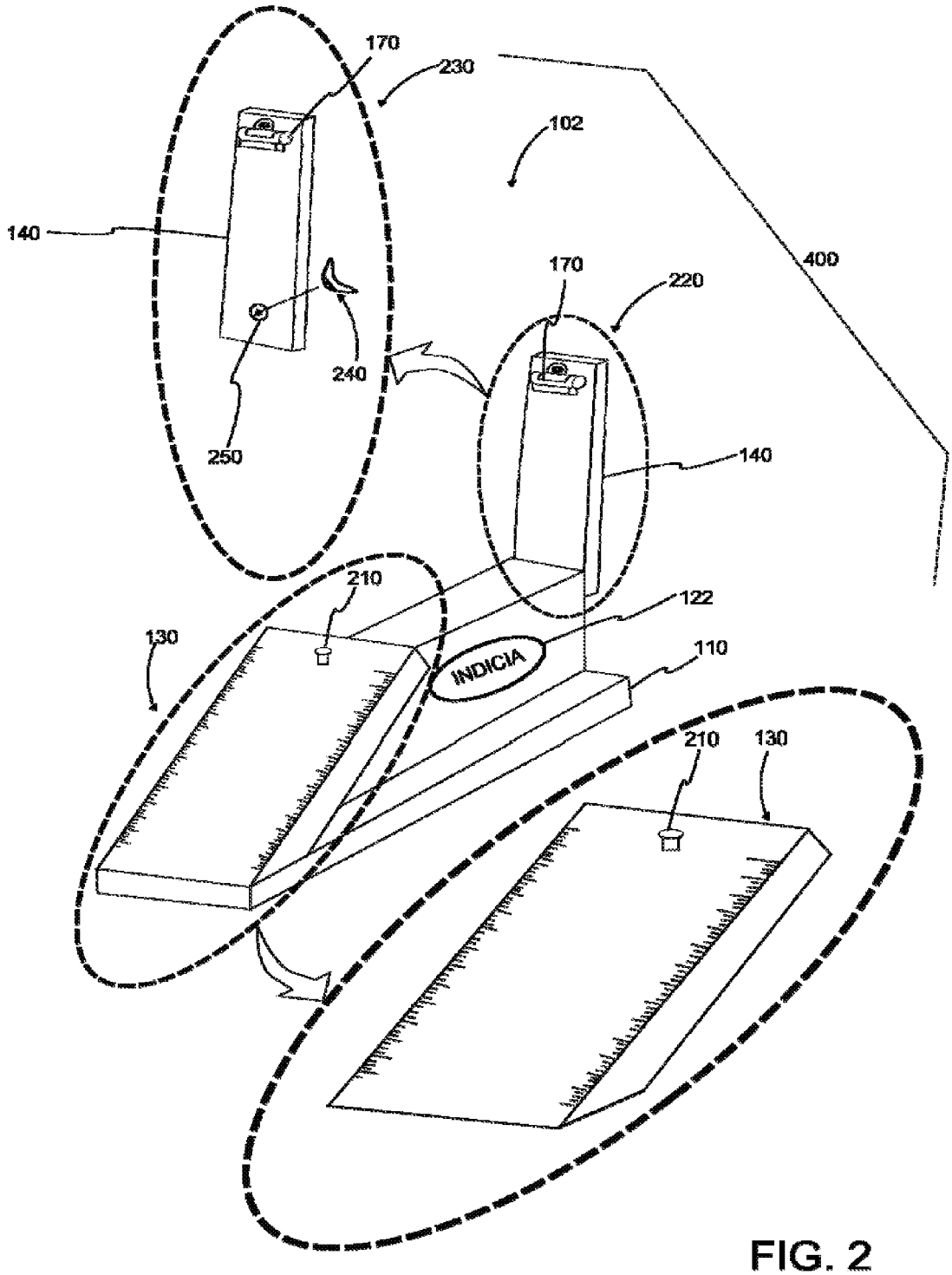
FIG. 2 illustrates an exploded view(s) showing an inclined sizing plate and a support arm of the Beadin' Butler system according to an embodiment of the present invention of FIG. 1.

Stabilizer 120 within the present embodiment may be mounted substantially perpendicular to support base 110 via appropriate attaching means such as adhesives, fasteners or other suitable mounting means or may be optionally integral with support base 110. Stabilizer 120 may be preferably mounted length-wise relative to support base 110 and is used to provide structural stability to weaving device 102. Stabilizer 120 within the embodiment shown may comprise upper plane 124, lower plane 125, first and second side planes 126 and 127, respectively, distal end plane and proximate end planes 128 and 129, respectively, wherein first and second side planes 126 and 127 may further comprise at least one location suitable for mounting at least one advertising indicia 122, as shown in FIG. 2 and alluded to in FIGS. 1, 3 and 4. Advertising indicia 122 may comprise the name Beadin' Butler or other such advertising and/or promotion means.

Stabilizer 120 may comprise substantially flat upper, lower, side and back planes and may comprise proximate end plane 129 having a cut-angle of about 45 degrees relative to lower plane 125 that is mounted to support base 110, as shown. Front portion of stabilizer 120 receives inclined sizing plate 130 at an angle of greater than, less than or equal to about 45 degrees as described previously, thereby providing a surface suitable for at least one user to create at least one beaded assembly 150. Inclined sizing plate 130 may be attached at a preferred angle comfortable and ergonomic for the user to manufacture beaded assembl(ies) 150. Within the embodiment shown the dimensions may comprise a length of about 9⅝" and a width of about 2½" and a height of about ⅜". Inclined sizing plate 130 as manufactured according to the embodiment shown comprises a cut-angle of about 45 degrees suitable for mounting to upper surface 112 of support base 110. Lower plane 125 of stabilizer 120 is coupled perpendicular on upper surface 112 of support base 110. It should be noted that the above-mentioned dimensions are approximate and are provided as an exemplary means in which to enable the present invention; however other dimensions may be applied and will still be considered to be within the scope and spirit of the invention as disclosed.

Figure 3:
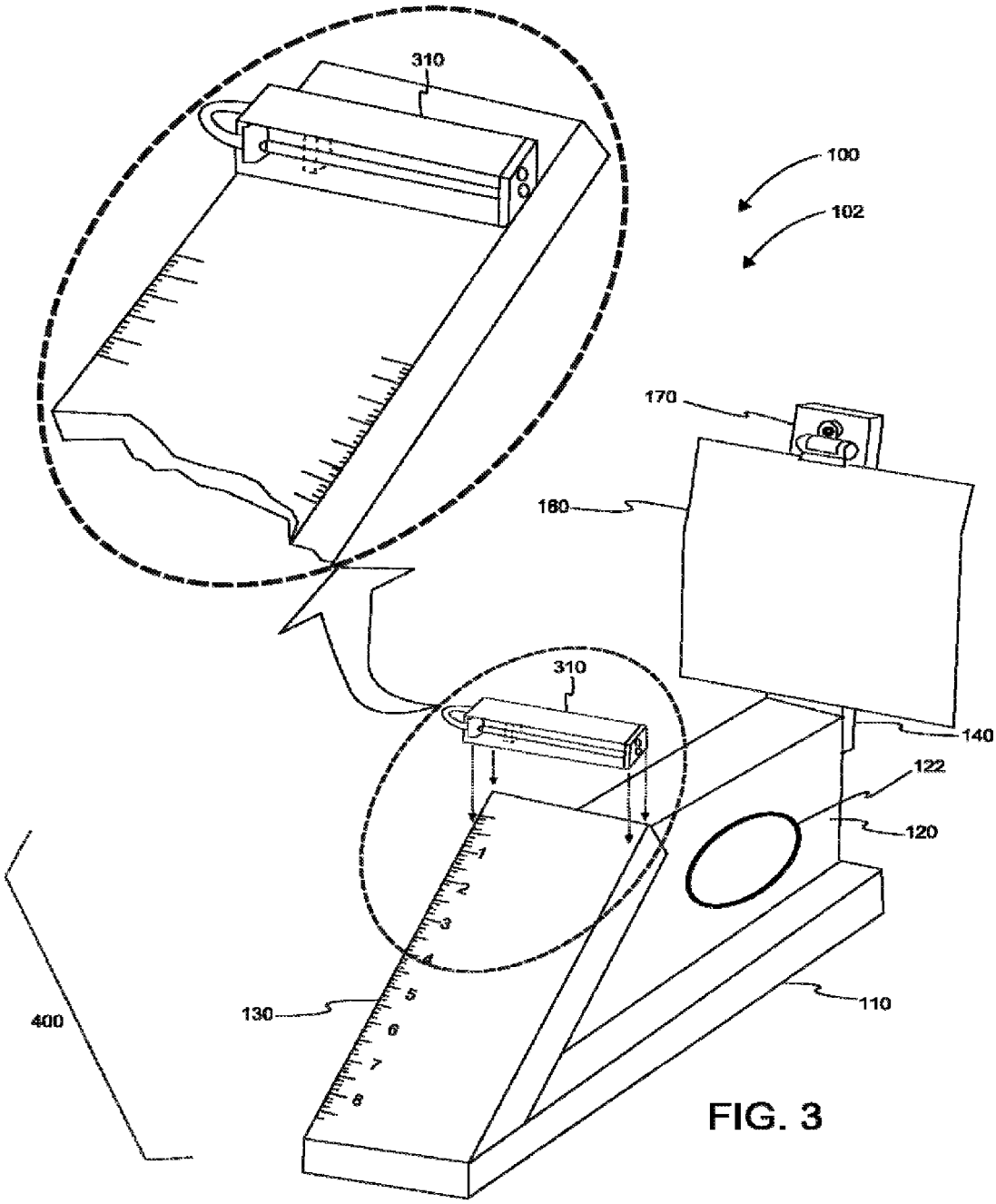
FIG. 3 is an exploded view illustrating a peyote block attachment in a removably couplable relationship with the inclined sizing plate of the Beadin' Butler system according to another embodiment of the present invention of FIG. 1.
Figure 4:
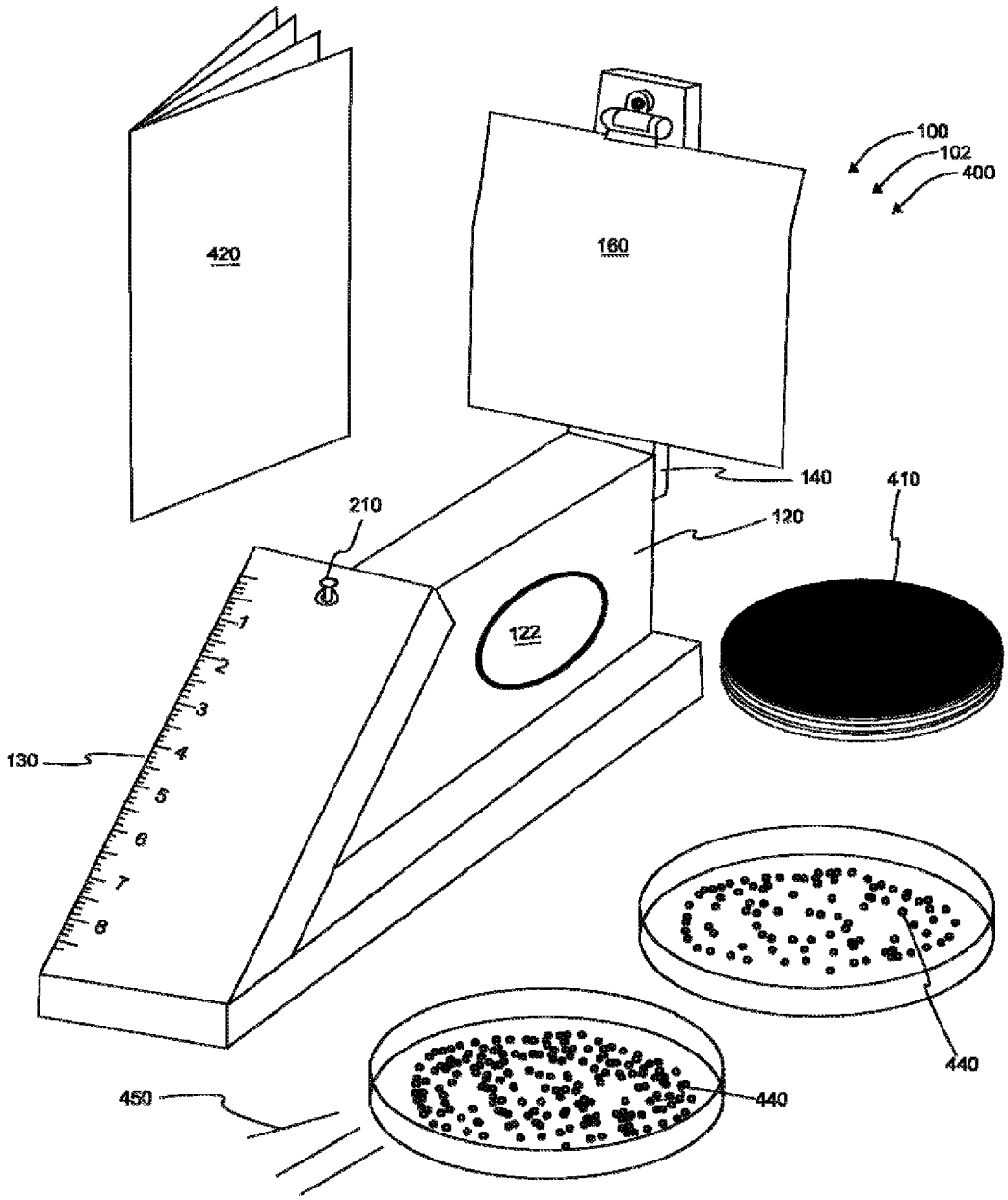
FIG. 4 is a perspective view illustrating a kit of the Beadin' Butler system according to an embodiment of the present invention of FIGS. 1-3.

Within certain embodiments inclined sizing plate 130 may comprise at least one imperial-measure graduated scale as shown in the present figure and in FIGS. 3 and 4. FIGS. 2 and 3 illustrate inclined sizing plate 130 of weaving device 102 comprising at least one imperial-measure graduated scale, and/or at least one metric-measure graduated scale that may be optionally included to provide easy measurement means for sizing and creating beaded assembly 150. Inclined sizing plate 130 may be referenced by instruction set 420 and may be divided into increments according to other suitable measurement systems that are referenced using analog or digital means. A preferred method of use 600 employing weaving device 102 of Beadin' Butler system 100 is shown and described in FIG. 6.

Stabilizer 120 may also comprise an attachment means to removeably attach support arm 140 thereto. Support arm 140 may be mounted parallel to and upwardly-rising from stabilizer 120, sufficient to comprise a vertical stabilizing means on which to position instruction sheet 160. The securement of instruction sheet 160 on support arm 140 effectively allows a user to employ both of their hands for weaving with instruction sheet 160 at eye level. In this manner the present invention provides a viewable instruction sheet 160 to guide the user while creating beaded assembly 150. Support arm 140 may comprise wood or other suitable material and may have approximate dimensions including a length of about 11⅝", a width of about 1½" and a height of about ¼". Support arm 140 may also comprise a 5/16" through hole which may provide a mounting means for support arm 140 to stabilizer 120 via bolt or other attaching means (not shown). It should be noted that the above-mentioned dimensions are approximate and are provided as an exemplary means in which to enable the present invention; however other dimensions may be applied and will still be considered to be within the scope and spirit of the invention as disclosed. Support arm 140 may also comprise a holding means such as clip 170, used to secure instruction sheet 160, as shown. Clip 170 may comprise other suitable attaching means such as for example other forms of clips, buttons, nails, adhesives, and/or hook and loop fasteners.

Referring now to FIG. 2, illustrating an exploded view(s) of weaving device 102 showing inclined sizing plate 130 and support arm 140 of Beadin' Butler system 100 according to an embodiment of the present invention of FIG. 1.

The present figure shows exploded views pointing out the novel features of inclined sizing plate 130 and support arm 140. As shown and discussed previously, inclined sizing plate 130 may comprise an imperial-measure graduated scale, and/or a metric-measure graduated scale that may be optionally included to provide easy measurement means for sizing and creating beaded assemblies 150. In this way the present invention promotes accuracy in sizing of beaded assemblies 150 because a user may quickly and accurately measure a length of thread or fishing line 410 in a convenient manner according to instruction sheet 160. The total thread length of thread 430 will be determined by the final design requirements of beaded assembly 150 (the article being woven). Thread lengths are normally indicated in the weaving instructions provided in the list of materials. Inclined sizing plate 130 may further comprise at least one toggle half securer 210, also shown in FIG. 4 and in-use in FIGS. 1 and 5. Toggle half securer 210 comprises securing means to attach a length of thread 430 or fishing line 410 whereby a user may insert beads 440 onto the length of thread 430 or fishing line 410 to create beaded assembly 150, as shown in FIG. 1. Inclined sizing plate 130 is preferably coupled to proximate end plane 129 of stabilizer 120 and to support base 110. Toggle half securer 210 is utilized in secured conjunction with brass pin 260 for positioning and supporting beaded assembly 150 while on inclined sizing plate 130. Brass pin 260 is preferably located directly in the center in the upper quadrant of inclined sizing plate 130. Pin 260 may also comprise other suitable materials in alternate embodiments. Toggle half securer 210 may comprise a clasp comprising a bar which fits into a loop.

In the present figure, support arm 140 is also illustrated in a coupled position 220 and a decoupled position 230, illustrating how support arm 140 may be removably couplable to and from stabilizer 120, as also described previously. Wing nut 240 or other suitable attaching means may be used to provide attaching means for support arm 140 to distal end plane 128 of stabilizer 120. Wing nut 240 is threadingly attached to a bolt (not shown) inserted through aperture 250, the bolt being preferably located integral with distal end plane 128 of stabilizer 120. In this manner support arm 140 may be removably coupled to distal end plane 128 via fastening means, further comprising at least one securing means for removably attaching at least one set of user-selectable weaving instructions found on instruction sheet 160. Alternately, support arm 140 may be attached to support base 110 or other suitable surface.

Referring now to FIG. 3, an exploded view illustrating peyote block attachment 310 in a removably couplable relationship with inclined sizing plate 130 of Beadin' Butler system 100 according to another embodiment of the present invention of FIG. 1.

Peyote stitch is a basic bead weaving technique traditionally used to create beaded pieces or beaded assemblies 150 without a loom. This stitch allows the user-beader to create a beaded fabric without a loom or visible thread. By zig-zagging the thread thru offset rows of beads 440, substantially any user-preferred size or shape may be created. The offset alignment achieved with peyote stitches give texture and interest to beaded assemblies 150. The present invention provides Peyote stitching means via peyote block attachment 310, which may be removably coupled to inclined sizing plate 130 of weaving device 102, as shown. In this way Beadin' Butler system 100 permits a user to perform a Peyote stitch. Other such stitches may also be performed using the present invention and it should be realized that the Peyote stitch has been enabled for exemplary means and that the present invention is by no means meant to be limited by such disclosure. Other instruction for other related uses may be found in instruction set 420.

Referring now to FIG. 4 showing a perspective view illustrating kit 400 of Beadin' Butler system 100 according to an embodiment of the present invention of FIGS. 1-3. It should also be noted that FIGS. 2 and 3 make reference to kit 400. Kit 400 may comprise the following parts: weaving device 102; at least one a set of user instructions, instruction set 420 and a plurality of bead-weaving instructions on instruction sheets 160 for creating at least one jewelry item, beaded assembly 150 comprising necklaces, bracelets, anklets in at least one form of cross-weaving, peyote, and/or chain maille. Kit 400 may also comprise at least one set of seed beads 440; at least one toggle half securer 210; needles 450; and optionally thread 430.

Kit 400, as mentioned may include seed beads 440. Seed beads 440 are preferably uniformly shaped, spheroidal beads ranging in size from under a millimeter to several millimeters. Beads 440 are substantially rounded in shape and are inserted onto fishing line 410 or thread to form beaded assembly 150 to form jewelry preferably via needles 450.

Beadin' Butler system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
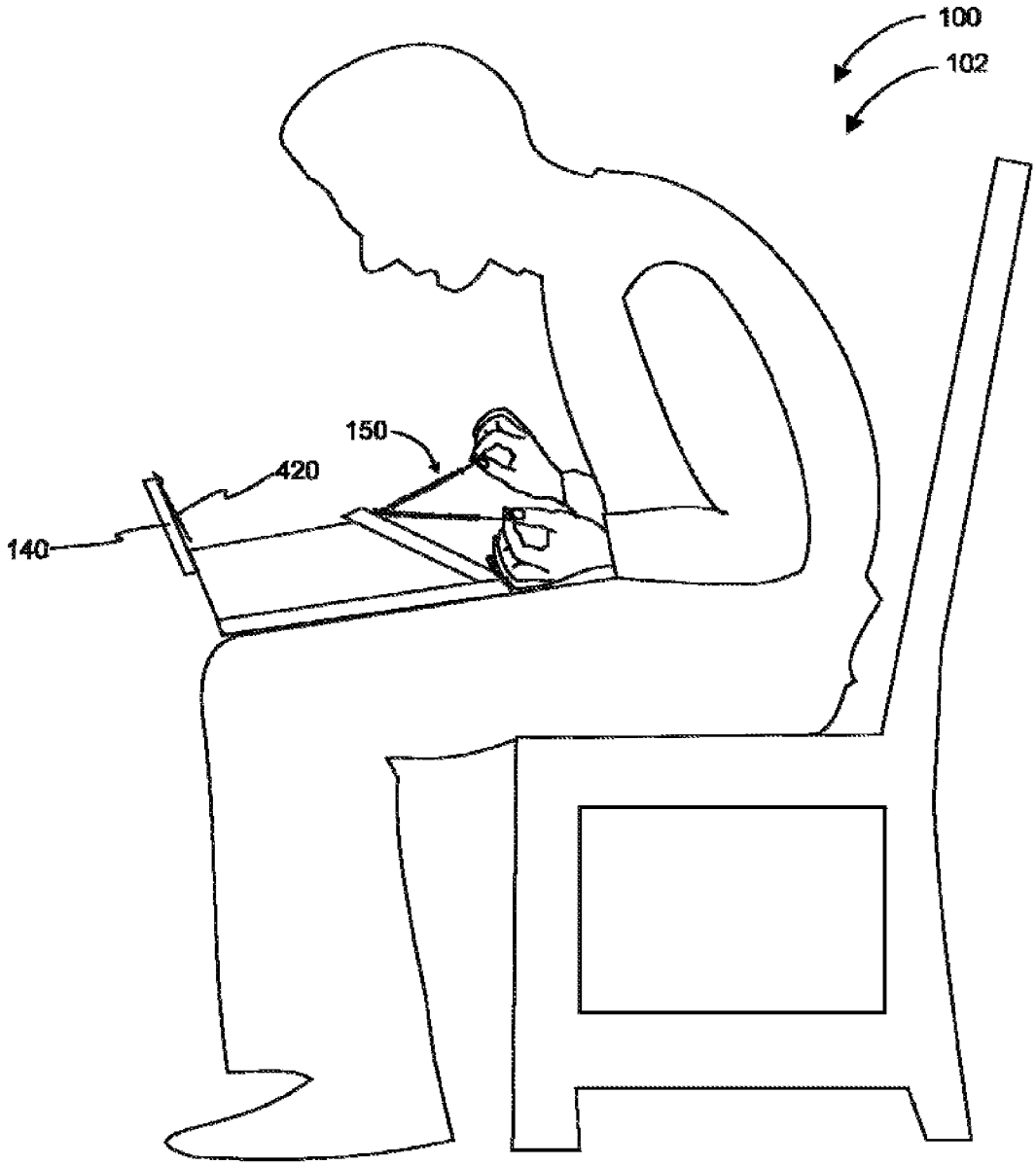
FIG. 5 is a perspective view illustrating the Beadin' Butler weaving device in an in-use condition on a lap of a user according to an embodiment of the present invention of FIG. 1.

Referring now to FIG. 5 showing a perspective view illustrating weaving device 102 of Beadin' Butler system 100 in an in-use condition on a lap of a user according to an embodiment of the present invention of FIG. 1. As discussed previously in FIG. 1 weaving device 102 is suitable for use on a substrate such as a table or may be used on the lap of a user when desired. To facilitate stability of weaving device 102, stabilizer 120 comprises a substantially wide support base 110 thereby permitting weaving device 102 to be self-supporting for use on either a table-top or on top of a user's lap. In this manner the present invention may be used in many different locations and is convenient as well as efficiently portable.

Figure 6:
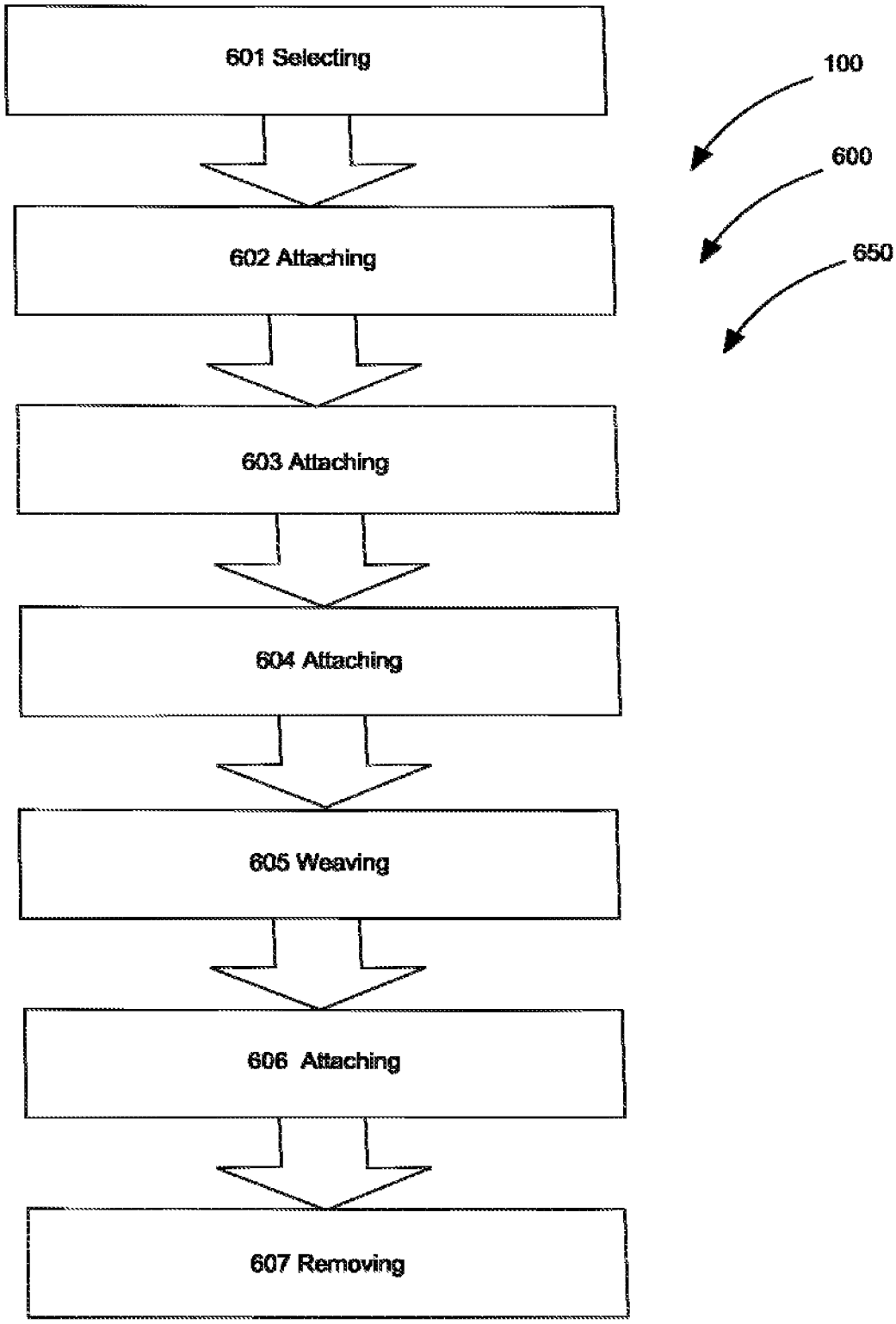
FIG. 6 is a flowchart illustrating a method of use according to an embodiment of the present invention.

Referring now to FIG. 6, showing flowchart 650 illustrating a method of use 600 according to an embodiment of the present invention of FIGS. 1, 2, and 3.

In accordance with the embodiments of the present invention a preferred method of use 600 for weaving device 102 of Beadin' Butler system 100 is disclosed herein comprising the steps of: step one 601 selecting at least one toggle half securer 210 to be used with beaded assembly 150, a piece of jewelry such as but not limited to a bracelet, necklace, or anklet; step two 602 attaching at least two equal lengths of thread 430, preferably fishing line 410 having a first end and second end to toggle half securer 210, thereby centering the equal lengths of thread 430 on toggle half securer 210 and attaching at least two beading needles 450 to the first end and second end of thread 430, said length of thread 430 being determined by set of instruction sheets 160; step three 603 attaching instruction sheet 160 via securing means to a support arm 140; step four 604 continuing weaving until a desired length of beaded assembly 150 is completed according to at least one graduated scale located on inclined sizing plate 130; step five 605 attaching a complementary toggle bar to the first and second thread ends and securing the first and second thread ends together; step six 606 removing residual of the first and second thread ends from beaded assembly 150; step seven 607 wiping beaded assembly 150 to remove any smudges or oil residue left on the jewelry assembly/beaded assembly 150 caused by handling beaded assembly 150. The steps are provided for use with weaving device 102 which is adapted for use on the lap of a user or on a suitable substrate. Peyote block attachment 310 may or may not be used within method of use 600. Optional steps of method of use 600 are shown in dashed lines in flowchart 650.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance and cleaning steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A bead weaving device comprising:

an inclined sizing plate comprising at least one toggle half securer;

a stabilizer;

wherein said stabilizer receives said inclined sizing plate at an angle suitable for a user to create at least one beaded assembly; and wherein said bead weaving device is adapted for use on a user's lap.

2. The bead weaving device of claim 1 further comprising a support base.

3. The bead weaving device of claim 2 further comprising a support arm further comprising at least one securing means for removably attaching at least one set of weaving instructions.

4. The bead weaving device of claim 2 wherein said inclined sizing plate comprises at least one imperial-measure graduated scale.

5. The bead weaving device of claim 2 wherein said inclined sizing plate comprises at least one metric-measure graduated scale.

6. The bead weaving device of claim 2 wherein said inclined sizing plate comprises an imperial-measure and a metric-measure graduated scale.

7. The bead weaving device of claim 2 wherein said stabilizer comprises an upper surface, a lower surface, a first and second side surface, a distal end surface, and a proximate end surface.

8. The bead weaving device of claim 7 wherein said lower surface of said stabilizer is coupled perpendicular on top surface of said support base.

9. The bead weaving device of claim 8 wherein said proximate end surface of said stabilizer comprises an angle of about 45 degrees relative to said support base.

10. The bead weaving device of claim 9 wherein said inclined sizing plate is coupled to said proximate end surface of said stabilizer and to said support base.

11. The bead weaving device of claim 10 further comprising said support arm being removably coupled parallel to said distal end surface via fastening means.

12. The bead weaving device of claim 7 wherein said first and second side surface further comprise at least one location suitable for mounting at least one advertising indicia.

13. The bead weaving device of claim 9 wherein said proximate end surface of said stabilizer comprises an angle of less than 45 degrees relative to said support base.

14. The bead weaving device of claim 9 wherein said proximate end surface of said stabilizer comprises an angle of more than 45 degrees relative to said support base.

15. A bead weaving device comprising the following components:

an inclined sizing plate including, an imperial-measure graduated scale and a metric-measure graduated scale, a brass toggle half securer, and a peyote block attachment;

a stabilizer having, an upper surface, a lower surface, a first and second side surface, a distal end surface, and a proximate end surface;

wherein said first and second side surface further comprise at least one location suitable for mounting at least one advertising indicia a support base adapted for use on the lap of a user or on the surface of a substrate;

a support arm removably coupled to said distal end surface via fastening means, further comprising at least one securing means for removably attaching at least one set of user-selectable weaving instructions;

wherein said stabilizer is coupled perpendicular on top surface of said support base; and wherein said stabilizer receives said inclined sizing plate at an angle of more or less than or equal to 45 degrees, suitable for a user to create at least one beaded assembly.

16. The bead weaving device of claim 15 wherein said components comprise a kit further comprising a set of user instructions and a plurality of bead-weaving instructions for creating at least one jewelry item comprising necklaces, bracelets, anklets in at least one form of cross-weaving, peyote, and/or chain maille.

17. A method of using a bead weaving device comprising the steps of:

selecting at least one toggle half ring;

attaching at least two equal lengths of thread having a first and second end to said toggle half, thereby centering said equal lengths of thread on said toggle half ring and attaching at least two beading needles to the first and second ends of said thread, said length of thread being determined by a set of user-instructions;

attaching said user-instructions via securing means to a support arm;

continuing weaving until a desired length of jewelry assembly is completed according to at least one graduated scale located on an inclined sizing plate;

attaching a complementary toggle bar to said first and second thread ends and securing said first and second thread ends together;

removing residual of said first and second thread ends from said jewelry assembly; and wherein said bead weaving device is adapted for use on the lap of a user or on a substrate.

18. The method of using a bead weaving device of claim 17 further comprising the step of wiping said jewelry assembly to remove any smudges or oil residue left on said jewelry assembly caused by handling said jewelry assembly.

19. The method of using a bead weaving device of claim 17 wherein said thread comprises fishing line.

* * * * *